United States Patent [19]

Florian

[11] 4,049,187

[45] Sept. 20, 1977

[54] THERMOFORMED HOT DRINK CUP

[75] Inventor: John Florian, Bakersfield, Calif.

[73] Assignee: Mobil Oil Corporation, New York, N.Y.

[21] Appl. No.: 661,209

[22] Filed: Feb. 25, 1976

Related U.S. Application Data

[63] Continuation-in-part of Ser. No. 511,144, Oct. 2, 1974, abandoned.

[51] Int. Cl.[2] ..... B65D 1/26; B65D 23/10

[52] U.S. Cl. ..... 229/1.5 B; 206/519; 220/94 A

[58] Field of Search ..... 206/506, 515, 519, 520; 220/94 A; 229/1.5 B, 1.5 C, 1.5 H

[56] References Cited

U.S. PATENT DOCUMENTS

| | | | |
|---|---|---|---|
| 1,121,259 | 12/1914 | Klin | 229/1.5 B |
| 2,051,940 | 8/1936 | Chichester-Miles | 220/94 A X |
| 2,283,019 | 5/1942 | Serr | 229/1.5 B |
| 2,932,437 | 4/1960 | Wilcox | 229/1.5 B |
| 2,937,783 | 5/1960 | Press et al. | 206/515 X |
| 3,381,849 | 5/1968 | Karlsson | 229/1.5 B X |

FOREIGN PATENT DOCUMENTS

| | | | |
|---|---|---|---|
| 676,809 | 7/1966 | Belgium | 220/94 A |
| 1,941,526 | 2/1970 | Germany | 220/94 A |
| 308,781 | 2/1969 | Sweden | 229/1.5 B |

*Primary Examiner*—Stephen Marcus

*Attorney, Agent, or Firm*—Charles A. Huggett; Ronald J. Cier

[57] ABSTRACT

Thermoformed cups, having elements adapted to provide a stable handle, which are nestable in a small space, the handle including a tab extending radially from the brim of the cup and a hinged flange at each side of the tab. To form the handle the flanges are turned down and are retained by shoulders of a recess in the upper surface of the cup. Weight of liquid in the cup causes the flanges to bear against the side of the cup to afford stability in addition to that resulting from retention by said shoulders.

7 Claims, 10 Drawing Figures

FIG. 1
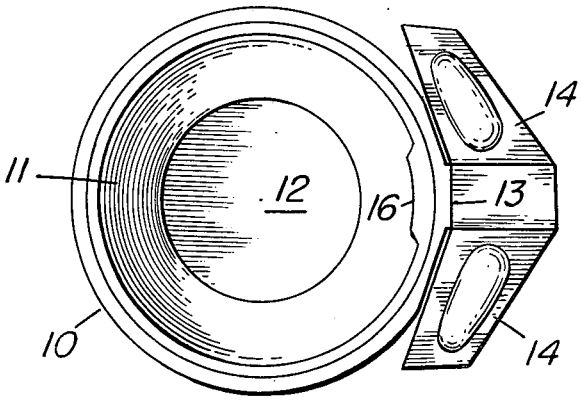
FIG. 2
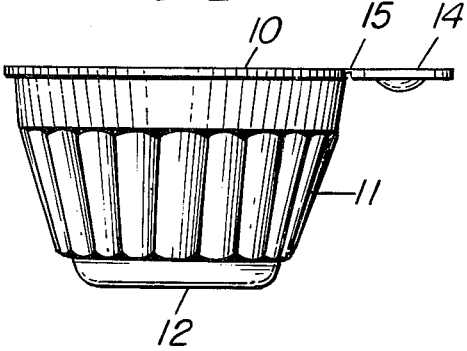
FIG. 4
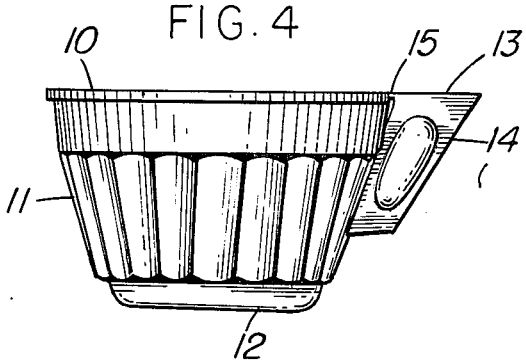
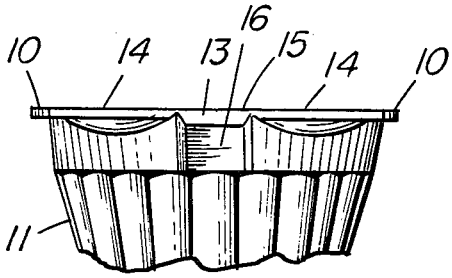
FIG. 3
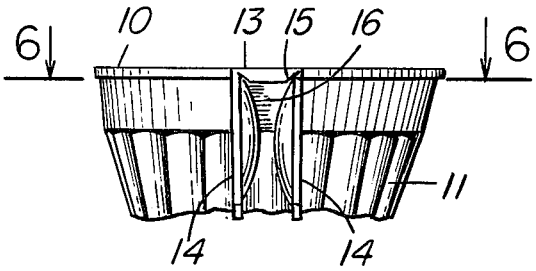
FIG. 5
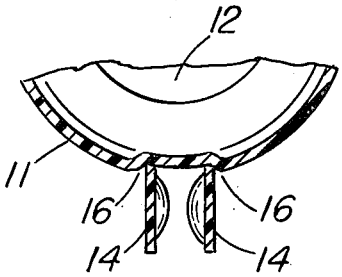
FIG. 6

THERMOFORMED HOT DRINK CUP

This application is a continuation-in-part of co-pending application Ser. No. 511,144 of Oct. 2, 1974, now abandoned.

BACKGROUND OF THE INVENTION

Disposable hot drink cups presently available may depend on insulating qualities of the material used or manner of fabrication to insulate the hand of the user from temperature of the contents or a handle may be provided to afford means to hold the cup without touching its outer walls.

As examples of the first class, mention may be made of thermoformed plastic foam and double walled cups. The insulating properties of foam are good and nestable cups made therefrom are in wide use despite the lack of a convenient handle. Cups of similar utility result from union of two cup elements, one within the other to provide an insulating air space. The latter can be prepared by thermoforming or injection molding of thin plastic to provide two similar elements, one slightly smaller than the other. The small element is placed within the larger and the upper edges are rolled outwardly together to firmly crimp the combination and provide a rounded brim pleasing to the touch.

Handles have been provided on cups of suitably treated paper by glue attachment along the side near the brim of a paper element which has unglued flanges which fold out to provide a handle. These nest very well because the handle element lies flat against the outside of the cup until folded out for use. Handled plastic cups have been made by injection molding. In order to provide enough bearing surface against the cup to be stable in use, the handle must be attached to the cup along a significant length. The length of attachment necessarily reduces nestability, resulting in undue requirement of space for shipping and storage. The length of attachment is therefore a compromise between stability on the one hand and space requirements on the other.

SUMMARY OF THE INVENTION

A handle is provided on a thermoformed cup by an integral tab which extends radially and outwardly from the upper edge of the cup. On each side of the tab is a hinged flange adapted to bear against the side of the cup along the length of the flange when rotated downwardly 90° about the hinge. The upper portion of the outer wall of the cup is recessed adjacent the tab to provide two vertically disposed shoulders which coact with the flanges to hold the latter in position as a handle. Such cups nest snugly and provide stable cups for drinking as will be apparent from the description below when considered together with the annexed drawings.

BRIEF DESCRIPTION OF THE DRAWINGS

FIG. 1 is a plan view of a cup formed in accordance with this invention;

FIG. 2 is an elevation of the cup of FIG. 1 showing a side view of the elements from which the handle may be formed;

FIG. 3 is a fragmentary elevation from a view at right angles to that of FIG. 2;

FIG. 4 is a fragmentary elevation showing the handle in operative position from the side;

FIG. 5 is a fragmentary elevation like that of FIG. 3 with the handle in operative position;

FIG. 6 is a section on line 6—6 of FIG. 5;

DESCRIPTION OF PREFERRED EMBODIMENTS

Figure 7:
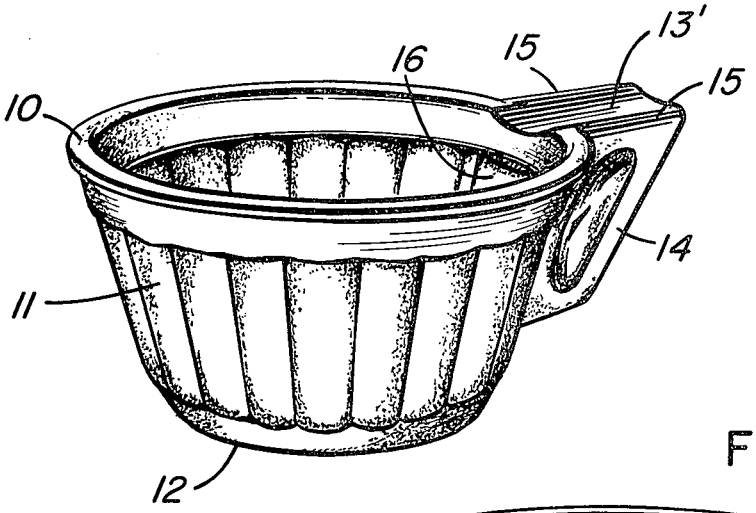
FIGS. 7 and 8 are perspective views of an alternate form of the present invention.
Figure 8:
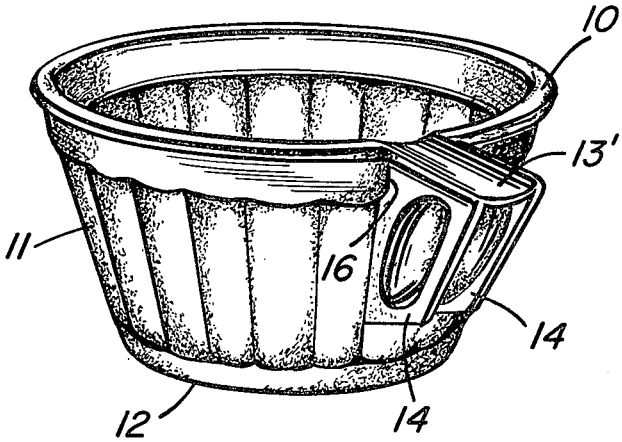
Figure 9:
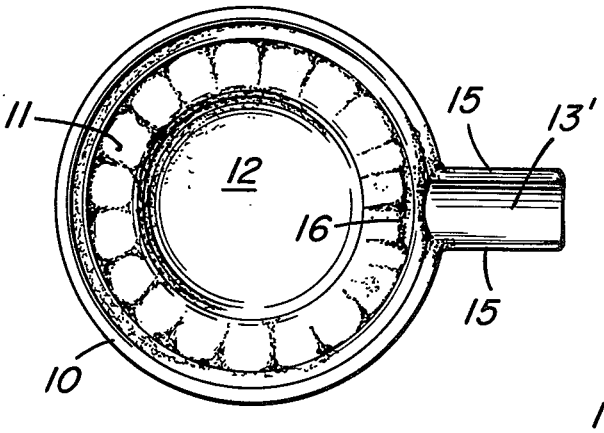
FIG. 9 is a top plan view of the cup of FIGS. 7 and 8.

As compared with prior practices, the present invention makes it possible to use the efficient and inexpensive thermoforming technique in the manufacture of cups with integral handles. In the past, the handle has been provided as a separately manufactured part, e.g. of wire adapted to be clipped on the separately formed base.

Although the invention is applicable to thermoforming of any suitable resin, either foam or clear sheet, it is preferred to employ foamed polystyrene because of the ability to make flexible stable hinges of that material. The details of the invention accordingly will be explained with respect to a hot drink cup thermoformed of foamed polystyrene. Preparation of the foamed resin is conventional and will not be described further.

In the typical embodiment best seen in FIGS. 1 and 2, the cup is formed to have an upper brim portion 10 which is preferably sloped slightly to converge downwardly and meet with inwardly sloped main side wall 11 which terminates at a flat bottom 12.

Extending radially outward from the top edge of brim portion 10 is a tab extension 13 formed integral with the brim portion 10 during the thermoforming operation. Along each side of tab 13 is a flange 14 formed at the same time. The foam between tab 13 and flange 14 is compressed and may be perforated in the thermoformer mold or later to provide an integral hinge 15 between tab 13 and each flange 14.

As will be seen most clearly in FIG. 6, a length of brim portion 10 is depressed adjacent tab 13 to provide shoulders 16. As the flanges 14 are rotated downwardly about the hinges 15, they pass over the shoulders 16 and enter the depressed section of brim portion 10. The flanges are thereupon restrained from leaving the position in which they constitute an operative handle, the shoulders 16 providing a detent against that undesirable result.

As will be seen from FIG. 1, the inner edges of flanges 14, nearest the brim portion 10, generally follow the arcuate contour of the cup brim with the inner edge of the flange being immediately adjacent the brim at its point of attachment to the tab. Consequently, when the flanges 14 are rotated to handle position, substantially the entire length of those edges bear against the inwardly tapered wall 11 as seen in FIG. 4. This causes the handle, composed of tab 13 and flanges 14 to act like a cantilever, affording strength and stability to the entire assembly.

Figure 10:
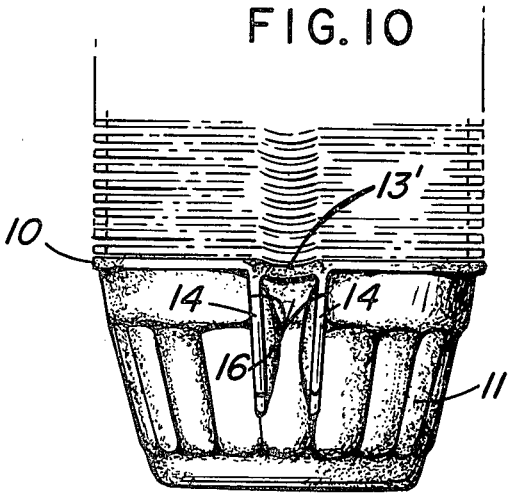
FIG. 10 shows a plurality of cups nested together, the bottom cup having its handle in the operative position and the remainder of the cups having their handles in the inoperative position.

The alternate form of the cup shown in FIGS. 7 - 10 is generally very similar to that of FIGS. 1 - 6 and corresponding reference numerals are used. This cup has a handle similar to the FIGS. 1 - 6 form, that is having a tab which is integrally formed and securely fastened to the cup brim. In the first form the top of the tab 13 is a substantially flat continuation of the brim as shown in FIGS. 3 - 5 while in the alternative form of FIGS. 7 – 10 the tab 13′ is a concave continuation of the brim. This concave construction strengthens the portion where the tab joins the brim. Because of the concavo-convex shape of tab 13′ the cups can readily be nested together as shown in FIG. 10. The flanges 14 are similar to those of the first form.

What is claimed is:

1. A nestable thermoformed cup and handle means formed integrally therewith in such fashion as to not interfere with nesting of stacked cups and to form a stable handle upon movement of the handle means to operative position comprising:

a. a cup body having an upper brim portion, a bottom of smaller dimension than said brim portion and sides tapering inwardly from said brim portion to said smaller bottom;

b. a tab integral with the upper edge of said brim portion extending outwardly therefrom and normal thereto; and c. a flange integrally hinged to each side of said tab and having an inner edge adjacent to and free of the brim portion, said inner edge being immediately adjacent the brim at its point of attachment to the tab and shaped to conform to the inwardly tapering side of cup body so that when the flanges are folded downwardly substantially the entire length of each inner edge will contact the side of the cup body to provide an elongated bearing surface against the body.

2. A cup and handle according to claim 1, wherein said brim portion is recessed adjacent said tab to provide shoulders adapted to retain said flanges when the same are rotated downwardly about their hinges to enter the recess adjacent said tab.

3. The cup of claim 1 including at least one elongated notch in the side of the cup body below the tab to receive the inner edges of the flanges when folded downwardly.

4. The cup of claim 1 in which said tab is a substantially flat extension of the brim.

5. The cup of claim 1 in which said tab is a concave extension of the brim.

6. The cup of claim 1 in which said tab is of concavo-convex cross section.

7. A nestable thermoformed cup and handle means formed integrally therewith in such fashion as to not interfere with nesting of stacked cups and to form a stable handle upon movement of the handle means to operative position comprising:

a. a cup body having an upper brim portion, a bottom of smaller dimension than said brim portion and sides tapering inwardly from said brim portion to said smaller bottom;

b. a tab integral with the upper edge of said brim portion extending outwardly therefrom and normal thereto; and c. a flange integrally hinged to each side of said tab and having an inner edge adjacent to and free of the brim portion, said inner edge being immediately adjacent the brim at its point of attachment to the tab and shaped to conform to the inwardly tapering side of cup body so that when the flanges are folded downwardly at least half of the length of each inner edge will contact the side of the cup body to provide an elongated bearing surface against the body, said brim portion having a recess adjacent said tap to provide shoulders which retain and contact said flanges adjacent the brim when they are rotated downwardly about their hinges.

* * * * *